United States Patent [19]

Kuus

[11] 4,132,243

[45] Jan. 2, 1979

[54] APPARATUS FOR FEEDING PERFORATION SEALER BALLS AND THE LIKE INTO WELL TREATING FLUID

[75] Inventor: Felix Kuus, Huntington Beach, Calif.

[73] Assignee: BJ-Hughes Inc., Long Beach, Calif.

[21] Appl. No.: 806,795

[22] Filed: Jun. 15, 1977

[51] Int. Cl.[2] ..... F17D 1/00

[52] U.S. Cl. ..... 137/268; 137/269; 166/75 R

[58] Field of Search ..... 137/268, 269; 15/104.06 A; 166/75, 70

[56] References Cited

U.S. PATENT DOCUMENTS

| | | | |
|---|---|---|---|
| 2,790,500 | 4/1957 | Jones | 15/104.06 A UX |
| 3,011,196 | 12/1961 | Glover | 137/268 UX |
| 3,291,217 | 12/1966 | Wakefield | 15/104.06 A X |

*Primary Examiner*—Alan Cohan

*Attorney, Agent, or Firm*—J. B. McGuire

[57] ABSTRACT

Apparatus for feeding perforation sealer balls into a stream of well treating fluid being pumped through a fluid flow line into a well, the apparatus having a housing, a tube in the housing for receiving sealer balls, the tube communicating with the fluid flow line for the passage of sealer balls from the tube into the flow line. There is provided a tubular sealer ball magazine that communicates with the tube for the transfer of sealer balls from the magazine into the tube. A plunger is reciprocably mounted in the tube for movement between a retracted position, in which the plunger is clear of the juncture of the magazine with the tube to allow a sealer ball to move into the tube, and an extended position, in which the plunger closes the juncture of the magazine with the tube and also ejects a ball from the tube and into the fluid flow line. In order to counterbalance the outward force imposed on the plunger by the high pressure well treating fluid, means responsive to the pressure of the well treating fluid is provided for applying an inwardly directed counterforce to the plunger that is substantially equal to the outward force. So that the apparatus can be adapted to the feeding of perforation sealer balls of varying sizes, the magazine, the tube, and the innermost portion of the plunger are removable and can be replaced by another magazine, another tube, and another innermost portion. A double-action pneumatic actuating cylinder means is operatively associated with the plunger for reciprocating the same.

6 Claims, 4 Drawing Figures

APPARATUS FOR FEEDING PERFORATION SEALER BALLS AND THE LIKE INTO WELL TREATING FLUID

BACKGROUND OF THE INVENTION

1. Field of the Invention

This invention relates to improvements in apparatus for feeding perforation sealer balls or the like into a stream of well treating fluid being pumped through a fluid flow line into an oil or gas well. The apparatus of the invention may also be used for introducing other elements, such as pipe cleaning pigs, into fluid flowing at high pressure through a liquid flow pipe.

2. Description of the Prior Art

U.S. Pat. No. 2,754,910 to Derrick and Kaltenberger discloses a method and apparatus for temporarily and selectively closing some of the perforations in oil well casing so that treating fluid may be forced under pressure through other of the perforations and into the surrounding earth formation. In performing the method, perforation sealer elements, such as sealer balls, are introduced into the stream of treating fluid being pumped down the well. The sealer balls commonly have a metallic core surrounded by a coating of rubber or the like, and are adapted to become seated in those perforations taking fluid flow at the higher velocities to block the flow of fluid through those perforations and to permit flow through other, unblocked perforations.

In fracturing or acidizing operations, for example, the treating fluid is pumped into the well under high pressure, which may range from a few hundred psi to 15,000 psi or even higher. Thus, one of the problems involved is to overcome the high pressure of the fluid into which the sealer balls are injected.

Moreover, the size of the perforations to be sealed will vary depending upon the perforating equipment used to make them. Thus, in the practice of the perforation sealing process of the foregoing Derrick and Kaltenberger patent, the sealer balls that are injected into the fluid stream must be of the proper size to close the particular perforations encountered.

SUMMARY

A principal object of the invention is to provide apparatus for injecting sealer balls or similar elements into a flowing stream of high pressure fluid.

Another object is to provide apparatus for the foregoing purpose that is readily adapted to inject sealer balls having different diameters.

Still other aims, objects and advantages of the invention will be set forth in or be apparent from this description as it proceeds.

In one of its aspects, the invention resides in apparatus for feeding perforation sealer balls and the like into a stream of well treating fluid being pumped through a fluid flow line into, for instance, a well, including a tube for receiving sealer balls, the tube having its inner end provided with port means communicating with the fluid flow line for the passage of sealer balls from the tube into the flow line. A plunger reciprocable in the tube is provided for ejecting sealer balls from the tube into the fluid flow line, the plunger having an inwardly facing effective area subject to the pressure of the well treating fluid in the fluid flow line thereby producing a force biasing the plunger outwardly. Piston means are carried by the plunger, and cooperating cylinder means are provided in which the piston means is reciprocable. The apparatus has chamber means in communication with the outer end of the cylinder means, and fluid conduit means communicate the chamber means with the fluid flow line. The piston means has an outwardly facing effective area exposed to the pressure of fluid in the chamber means, thereby producing a force biasing said plunger inwardly, the inwardly facing effective area of the plunger being substantially equal in extent to the outwardly facing effective area of said piston means. Means such as a double-acting motor is operatively associated with said plunger for reciprocating the same.

In another of its aspects, the invention is embodied in apparatus for feeding perforation sealer balls and the like into a stream of well treating fluid being pumped through a fluid flow line into a well, including a housing, a tube in the housing for receiving sealer balls, the tube having its inner end provided with first port means communicating with the fluid flow line for the passage of sealer balls from the tube into the flow line. A tubular sealer ball magazine is removably attached to the housing and has second port means communicating with the tube for the transfer of sealer balls from the magazine into the tube. The apparatus has a plunger with a removable innermost portion, and the plunger is reciprocably mounted in the tube for movement between a retracted position, in which the innermost portion is clear of the second port means, and an extended position, in which the innermost portion closes the second port means and is proximate to the first port means for ejecting a sealer ball into the flow line. The tube comprises a sleeve removably mounted in the housing. The tube, the innermost portion, and the magazine each have a diameter substantially equal to the diameter of the sealer balls, whereby the apparatus may be converted to feed other sealer balls of a different diameter by removing the tube, the innermost portion, and magazine, and replacing them, respectively, with another tube, another innermost portion, and another magazine each having substantially the same diameter as the other sealer balls.

DESCRIPTION OF THE PREFERRED EMBODIMENT

Figures 1, 4:
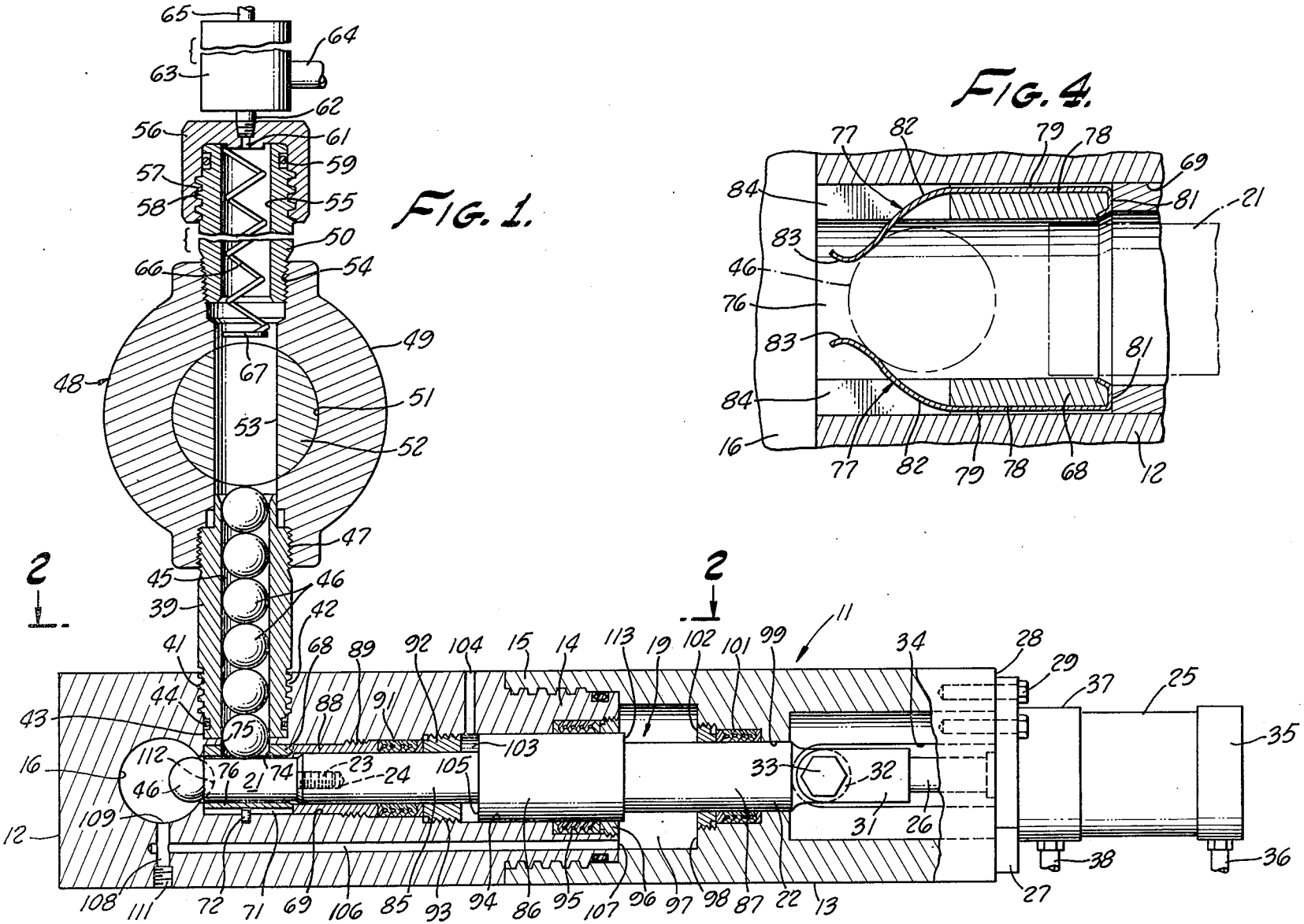
FIG. 1 is a vertical sectional view of apparatus in accordance with the invention for injecting perforation sealer balls into a stream of liquid being pumped under high pressure through a liquid flow line.
FIG. 4 is a sectional view taken along the line 4—4 of FIG. 3 and looking in the direction of the arrows.
Figure 2:
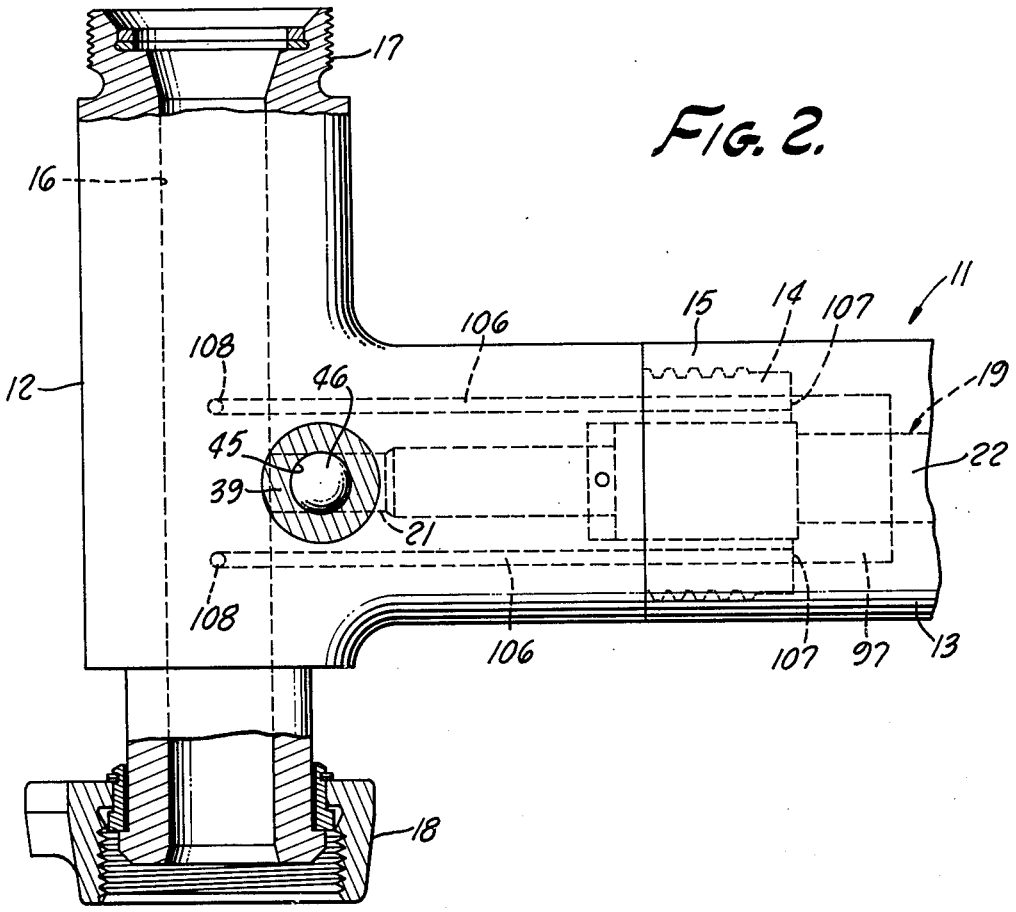
FIG. 2 is a sectional view, with portions broken away, taken along the line 2—2 of FIG. 1 and looking in the directions of the arrows.

Referring to the drawings, particularly to FIGS. 1 and 2, the sealer ball injector apparatus shown has a housing designated by the general reference numeral 11. The housing has a T-shaped front section 12 and a straight rear section 13 that is joined to the front section by a threaded pin 14 on the front section onto which is screwed a complementally threaded box 15 on the rear section.

The laterally extending portion of the T-shaped housing section 12 is provided with a bore 16 extending therethrough. This section forms part of a fluid flow line through which well treating fluid is pumped into a well (not shown). In order to connect the section 12 into the flow line, a threaded male connector element 17 is provided at one side and a complementarily threaded female connector element 18 at the other side. These connector elements are well known, and no further description thereof need be given. Suffice it to say that the flow line can be extended in both directions from the T-shaped housing section by connecting complemental pipe lengths in series with the connector elements 17 and 18.

Disposed within the housing and mounted for longitudinal reciprocating movement therein is a plunger, designated by the general reference numeral 19. The plunger is essentially a body of revolution about a longitudinal axis. It has an innermost cylindrical portion or ball ejector 21 and an outwardly extending main body portion 22. The innermost portion 21 is releasably fastened to the main body portion 22 by a stud 23 carried by the innermost portion and threadedly received in a corresponding hole 24 formed in the inner end of the main body portion.

The plunger 19 is reciprocated by an actuator or motor 25. In the apparatus shown, the motor is a double-acting, pneumatically driven, piston-and-cylinder motor provided with a piston rod 26. The motor has a mounting flange 27 by which it is connected to the outer end 28 of the housing by a number of machine screws 29 disposed around the flange, only two such screws being shown by way of illustration. The inner end of the piston rod carries a clevis 31 loosely fitted about a flattened tongue 32 formed at the outer end of the plunger 19. The tongue is secured to the clevis by a clevis pin 33 that can be installed and removed through a window 34 provided in a side of the housing section 13. A similar window (not shown) is cut through the opposite side of the housing to facilitate installation and removal of the clevis pin.

The motor is driven by compressed air from a source (not shown). Compressed air from the source is admitted into the head end 35 of the motor from an air line 36 to drive the piston to the left or inwardly as seen in FIG. 1. Air in the rod end 37 of the motor is discharged through another air line 38 as the piston moves to the left. The motor is reversed to move the piston to the right or outwardly by admitting compressed air into the rod end of the cylinder through the air line 38 while simultaneously exhausting air from the head end of the cylinder through the air line 36. The length of stroke of the piston in the motor 25 is determined by internal stop members (not shown) that limit movement of the piston in both directions of its travel. As the details of construction of the piston-and-cylinder motor 25 and the valving and piping required to admit and exhaust air from the cylinder are well-known, further description thereof is believed to be unnecessary. Because the plunger 19 is connected to the clevis 31 without longitudinal play therebetween, it is clear that the length of the stroke of the plunger is the same as that of the piston.

A sealer ball magazine 39 is removably mounted on the housing section 12 adjacent to the center of the innermost portion 21 of the plunger when the latter is in the extended position shown in FIGS. 1 and 2. For this purpose, the magazine has external machined threads 41 at its lower end that mate with internal machined threads 42 in a bore 43 provided in the front housing section 12. The machined threads permit the magazine to be readily detached from the housing. An O-ring seal 44 seals the magazine to the front housing section. The magazine has an axial bore 45 therethrough of a diameter to freely accommodate a vertical column of perforation sealer balls 46.

Secured to the top of the magazine 39 by a threaded joint 47 is a plug valve 48. The valve has a case 49 providing a lateral bore 51 in which a valve plug 52 is rotatably mounted. A handle (not shown) is affixed to the plug for turning it to open and closed positions. The plug has a transverse bore 53 which, in the valve-open position shown in FIG. 1, is aligned with the bore 45 in the magazine, the bore 53 being somewhat larger in diameter than the bore 45, so that the sealer balls can easily pass through it.

A vertical, tubular ball container 50 is threaded into a tapped hole 54 in the top of the valve case 49. An axial bore 55, of the same diameter as the magazine bore 45, is axially aligned with the latter.

The upper end of the ball container is closed by a cap 56 having internal machined threads 57 mated with external machined threads 58 on the top of the ball container. An O-ring seal 59 seals the cap to the ball container.

A vent 61 is provided in the cap, the vent communicating through a pipe nipple 62 with a pressure relief valve 63 having a discharge pipe 64, which may lead to a discharge sump (not shown). The discharge valve has a shaft 65 by which the valve can be operated to either vent pressure from the interior of the ball container or hold pressure therein.

A ball pusher including a spring 66 with a ball follower 67 at its lower end has its upper end attached to the cap 56. The ball follower can move, from the position shown, upwardly in the ball container against the bias of the spring. The ball pusher is removable with the cap 56 when the latter is disconnected from the ball container.

Figure 3:
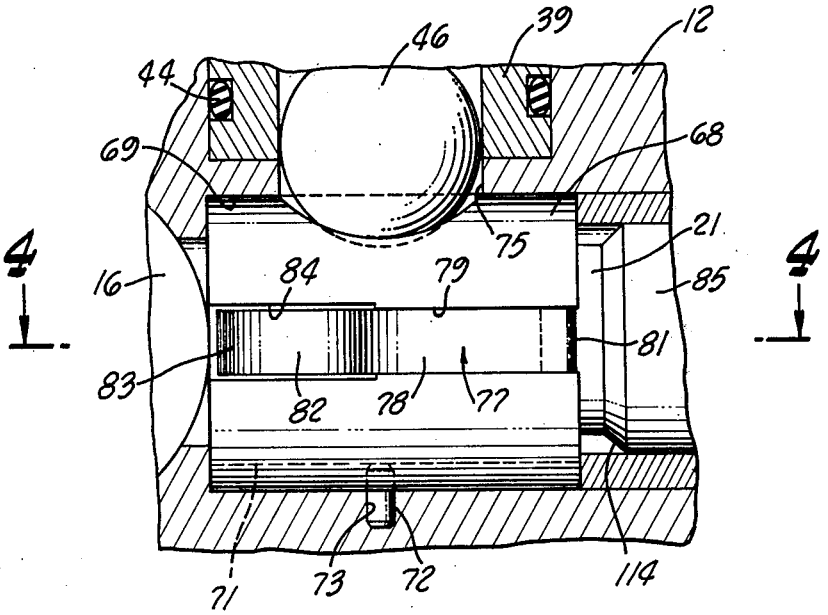
FIG. 3 is a fragmentary sectional view, on an enlarged scale, of the innermost end of the plunger and portions of the apparatus adjacent thereto.

Referring particularly to FIGS. 1, 3 and 4, it is seen that a ball ejector sleeve 68 surrounds the ball ejector 21 and provides a loose sliding fit therefor. The sleeve is snugly but slidably received in the inner end of a bore 69 in the front section 12 of the housing. A longitudinal slot 71 is milled in the bottom of the sleeve, and a pine 72 is mounted in a hole 73 in the housing front section and projects into the slot 71 to prevent the sleeve from rotating in the bore 69.

A transverse circular port 74 is provided in the top of the ejector sleeve 68 and is aligned with an adjacent port 75 in the front section of the housing. These ports are in alignment with the bore 45 of the magazine 39 and form a passage for the transferral of sealer balls from the magazine into a cylindrical bore 76 in the ejector sleeve when the ejector 21 is in an out-of-the way position, as seen in FIG. 4.

The ejector sleeve 68 is shown in FIGS. 3 and 4 as having a pair of identical, opposed, ball retainer spring fingers 77,77 formed by bending lengths of flat spring steel into the illustrated configuration. Each finger 77 has a shank 78 that is received in a slot 79 recessed in the side of the sleeve 68. The rear or outer end 81 of the spring finger is turned over the outer end of the sleeve to secure the finger to the sleeve. The front portion 82 of each spring finger is curved towards the axis of the sleeve and terminates in a recurved end 83. The front portion 82 projects into the bore 76 of the ejector sleeve through an opening 84 cut through the sleeve. As best seen in FIG. 4, the front portions 82,82 of the spring fingers normally retain a ball 46 in the bore of the ejector sleeve when the ejector is retracted, as shown. However, as the ejector 21 is moved to its extended position shown in FIG. 1, the fingers are spread apart by the passage of the ball and the ejector therebetween, and the ball is pushed into the bore 16 of the flow line and, thus, into the stream of fluid flowing therethrough. As the ejector is again retracted, the spring fingers return to the positions shown in FIG. 4, and another ball drops into the bore of the ejector sleeve.

As best seen in FIG. 1, the main body portion 22 of the plunger 19 may be formed as a unitary member from bar stock turned, for instance, on a lathe.

The main body portion has an inner section or ejector piston 85, an intermediate section or balance piston 86, and an outer section or actuator rod 87, with which the tongue 32, previously described, is integrally formed.

The ejector piston 85 is slidably received in an ejector sleeve retainer sleeve 88. The retainer sleeve is removably fastened in the bore 69 by a threaded connection 89. The inner end of the retainer sleeve abuts the outer end of the ejector sleeve to hold the latter in place. Packing 91 surrounds the ejector piston, the packing being compressed against the ejector piston by an ejector piston gland 92. The gland is threaded at 93 into an enlarged outer end of the bore 69.

The balance piston 86 slides in a balance piston cylinder 94. Packing 95, compressed by a balance piston gland 96, provides a working seal for the balance piston. At the outer end of the balance piston cylinder there is provided a balance chamber 97 that communicates with the balance cylinder and into which the balance piston may move on the outstroke of the plunger 19.

An outer end wall 98 closes the balance chamber 97 and provides a cylindrical rod opening 99 in which the actuator rod 87 is slidable. Packing 101 slidably seals the actuator rod in the opening 99, the packing being compressed about the rod by means of an actuator rod gland 102.

With the plunger 19 in its extended position, as seen in FIG. 1, the front section 12 of the housing provides, between the balance piston 86 and the ejector piston gland 92, a vent chamber 103 communicating with the ambient atmosphere through a vent passage 104. Thus, the front end 105 of the balance piston is exposed to atmospheric pressure. Any leakage from the balance chamber 97 past the balance piston will be received in the vent chamber 103, as will any leakage from the retainer sleeve 88 that flows past the retainer sleeve packing 91, and the leakage fluid will be vented to the exterior through the passage 104.

As seen in FIGS. 1 and 2, the balance chamber 97 is in fluid communication with the bore 16 of flow line through fluid conduits 106,106 that have openings 107,107 fluidically communicating these conduits with the balance chamber. The conduits join with fluid passages 108,108 that connect with the bore 16 at openings 109. Plugs 111 close the bottoms of the passages 108,108.

Referring to FIG. 1, it is seen that the front end of the ball ejector 21 has a concave depression 112 for receiving and centering a sealer ball 46 as it is being pushed into the bore 16 of the flow line.

It is seen that the balance piston 86 has an outwardly facing annular surface 113 disposed at right angles to the longitudinal axis of the plunger 19. The fluid pressure in the balance chamber acts upon this surface to urge the plunger inwardly. The annular surface 113 has a major diameter equal to the diameter of the balance piston 86, and a minor diameter equal to the diameter of the actuator rod 87. The area of the annular surface 113 is called the effective area of the piston or plunger that is exposed to the fluid pressure in the balance chamber. As is apparent, the surface 113 could be of any configuration, such as concave or convex, as long as its axial projection on a plane normal to the longitudinal axis of the plunger has an area equal to that of the surface 113.

It will also be seen that the plunger 19 is exposed to the pressure of the fluid in the bore 16 of the flow line which urges the plunger outwardly. The area upon which this pressure is exerted is equal to the cross-sectional area of the ejector piston 85. The actual surface upon which this pressure is effective are the surface of the front end of the ball ejector 21 and a tapered surface 114 (see FIG. 3) between the ball ejector and the ejector piston 85. An axial projection of these two surfaces upon a plane perpendicular to the longitudinal axis of the plunger defines an area equal to the cross-sectional or effective area of the ejector piston 85, and this area is denominated the effective area of the plunger that is exposed to the fluid pressure in the bore 16 of the flow line.

In accordance with the invention, the effective area of the plunger exposed to the pressure of fluid in the balance chamber and the effective area of the plunger exposed to the pressure of fluid in the bore of the flow line are, for all practical purposes, equal in extent. These effective areas are equalized by appropriate selection of the diameters of the ejector piston 85, the balance piston 86 and the actuator rod 87. In a typical embodiment, the diameter of the ejector piston is 1.5 inches, the diameter of the balance piston is 2.5 inches, and the diameter of the actuator rod is 2.0 inches. With these diameters, the respective effective areas are equal at 1.76715 square inches.

With the effective areas equal or substantially so, the force due to fluid pressure in the bore 16 biasing the plunger in the outward direction is counterbalanced by the force due to fluid pressure in the balance chamber 97 biasing the plunger inwardly, the pressures in the bore 16 and the balance chamber 97 being equalized through the fluid conduits 106,108. Thus, but little effort is needed to reciprocate the plunger, and the motor 25 need provide only relatively low thrust.

The ball injector of the invention is readily converted to handle sealer balls having, for example, a smaller diameter than those previously herein described. It is necessary to relate the diameter of the balls to the diameter of the perforations to be sealed. Since the size of the perforations will vary, depending upon the particular perforating equipment employed to make them, there is a distinct advantage in being able to adapt the ball injector to operate with balls of varying diameters.

Such conversion is readily effected by substituting for the magazine 39, the ejector 21, and the ejector sleeve 68, corresponding parts (not shown) sized to accommodate sealer balls of reduced diameter. These parts may be substituted without changing the hydrodynamic balance of the plunger.

Assume that the illustrated apparatus is of a size to accommodate sealer balls having a diameter of 1 ½ inches, and that it is desired to convert it to handle sealer balls having a diameter of 1 inch. The ball magazine 39 is unthreaded from the front section 12 of the housing and from the plug valve 48. A substitute magazine, having a bore diameter slightly greater than 1 inch and having suitable threads is assembled into the apparatus by screwing it into the plug valve 48 and the front section 12 of the housing.

To change the ejector and the ejector sleeve, the rear section 13 of the housing is disconnected from the front section 12 by unscrewing the connection provided by the pin 14 and box 15. The plunger 19 is then withdrawn from the front section 12 of the housing by moving the rear section 13 and the plunger to the right as seen in FIG. 1. The ejector 21 is removed from the ejector piston 85 by turning it to unthread the stud 23. A substitute ejector having a nominal 1inch diameter and an appropriately threaded stud is then screwed onto the ejector piston.

Next, the ejector piston gland 92, the packing 91, the retainer sleeve 88, and the ejector sleeve 68 are removed from the front section 12 of the housing. A substitute ejector sleeve, having a bore slightly greater than the diameter of the foregoing substitute ejector and an outside configuration like that of the ejector sleeve 68 is inserted in the bore 69 in place of the ejector sleeve 68. The retainer sleeve 88, the packing 91, and the gland 92 are then replaced. Thereafter, the plunger, with the substitute ejector, and the rear section 12 of the housing are reassembled into the apparatus, the pin-and-box connection 14,15 being made up to complete the conversion of the apparatus to handle 1 inch sealer balls.

It is evident that the hydrodynamic balance of the plunger 19 is not upset by the foregoing substitution of parts, since, in effecting the substitutions, no changes are made in the ejector piston 85 or the balance piston 86, and the respective effective areas remain the same.

In operation, with the apparatus set up as shown in FIG. 1, and with fluid under high pressure flowing through the bore 16 of front section 12 of the housing, the plunger is seen to be introducing a sealer ball 46 into the stream of fluid. Following the injection of the sealer ball into the stream of fluid, the motor 25 is energized to move the plunger to its retracted position as shown in FIG. 4. Another ball 46 falls from the magazine 39 into the bore 76 of the ejector sleeve, as also seen in FIG. 4. Then, the motor 25 is energized to advance the plunger to its extended position to thereby introduce this ball into the stream of fluid in the bore 16. This sequence of operations is repeated until the sealer balls in the magazine have been injected, one by one, into the stream of fluid.

To recharge the magazine, the plug valve 48 is closed, and pressure in the ball container 53 is bled off through the discharge pipe 64 by opening the pressure relief valve 63. The cap 56 is unthreaded from the ball container and removed, together with the ball pusher spring 66 and follower 67. A number of sealer balls is dropped into the ball container 53 and the cap 56, with its attachments, is replaced. The pressure relief valve is then closed. Thereafter, the plug valve 48 is opened to allow the sealer balls to be transferred into the magazine 39 by gravity as assisted by the ball pusher spring and follower. The apparatus is then ready for another ball injection cycle.

In the light of the foregoing description, modifications of the apparatus may be made without departing from the invention. The apparatus shown and described herein is merely exemplary of the invention, the scope of which is defined in the claims, and these are intended to be interpreted as broadly as the prior art will permit.

I claim:

1. Apparatus for feeding perforation sealer balls and the like into a stream of well treating fluid being pumped through a fluid flow line into a well, comprising a tube for receiving sealer balls, said tube having its inner end provided with port means communicating with the fluid flow line for the passage of sealer balls from the tube into the flow line, a plunger reciprocable in the tube for ejecting sealer balls from the tube into the fluid flow line, said plunger having an inwardly facing effective area subject to the pressure of the well treating fluid in said fluid flow line thereby producing a force biasing said plunger outwardly, piston means carried by said plunger, cooperating cylinder means in which said piston means is reciprocable, chamber means in communication with the outer end of said cylinder means, fluid conduit means communicating said chamber means with said fluid flow line, said piston means having an outwardly facing effective area exposed to the pressure of fluid in said chamber means thereby producing a force biasing said plunger inwardly, said inwardly facing effective area of said plunger being substantially equal in extent to said outwardly facing effective area of said piston means, and means operatively associated with said plunger for reciproacting the same.

2. Apparatus as defined in claim 1, including first seal means slidably sealing said plunger in said tube, and second seal means slidably sealing said piston means in said cylinder means.

3. Apparatus as defined in claim 1, wherein said chamber means has an outer end wall opposite to said piston means, said outer end wall providing an opening through which the outer end portion of said plunger reciprocably extends, and means slidably sealing said outer end portion in said opening, and double-acting motor means being operatively associated with said outer end portion of said plunger.

4. Apparatus as defined in claim 3, wherein said outer end portion of said plunger has a diameter smaller than the diameter of said piston means to provide, with said piston means, said outwardly facing effective area.

5. Apparatus as defined in claim 2, wherein said first and said second seal means are spaced longitudinally along said plunger to provide mutually opposed seal ends, said opposed seal ends being open to the atmosphere.

6. Apparatus for feeding perforation sealer balls and the like into a stream of well treating fluid being pumped through a fluid flow line into a well including a housing, a tube in said housing for receiving sealer balls, said tube having its inner end provided with first port means communicating with the fluid flow line for the passage of sealer balls from the tube into the flow line, a tubular sealer ball magazine removably attached to said housing and having second port means communicating with said tube for the transfer of sealer balls from said magazine into said tube, a plunger having a removable innermost portion, said plunger being reciprocatably mounted in said tube for movement between a retracted position, in which said innermost portion is clear of said second port means, and an extended position, in which said innermost portion closes said second port means and is proximate to said first port means for ejecting a sealer ball into the flow line, said tube comprising a sleeve removably mounted in said housing, said sleeve, said innermost portion, and said magazine each having a diameter substantially equal to the diameter of said sealer balls, whereby said apparatus may be converted to feed other sealer balls of a different diameter, by removing said sleeve, said innermost portion, and said magazine, and replacing them, respectively, with another sleeve, another innermost portion, and another magazine each having substantially the same diameter as said other sealer balls, and means in said housing for equalizing the pressure on the end of said plunger distal from said innermost portion with that exerted on said innermost portion by fluid in such a flow line.

* * * * *